US011509983B2

(12) United States Patent
Negishi et al.

(10) Patent No.: US 11,509,983 B2
(45) Date of Patent: Nov. 22, 2022

(54) AUDIO REPRODUCTION DEVICE

(71) Applicant: SONY GROUP CORPORATION, Tokyo (JP)

(72) Inventors: Takayuki Negishi, Tokyo (JP); Jun Komiyama, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 0 days.

(21) Appl. No.: 17/309,782

(22) PCT Filed: Nov. 20, 2019

(86) PCT No.: PCT/JP2019/045378
§ 371 (c)(1),
(2) Date: Jun. 17, 2021

(87) PCT Pub. No.: WO2020/137269
PCT Pub. Date: Jul. 2, 2020

(65) Prior Publication Data

US 2022/0053252 A1 Feb. 17, 2022

(30) Foreign Application Priority Data

Dec. 27, 2018 (JP) ..... JP2018-244036

(51) Int. Cl.
*H04R 1/02* (2006.01)
*H04R 3/00* (2006.01)

(52) U.S. Cl.
CPC ..... *H04R 1/026* (2013.01); *H04R 1/028* (2013.01); *H04R 3/00* (2013.01)

(58) Field of Classification Search
CPC ..... H04R 1/026; H04R 1/028; H04R 3/00
See application file for complete search history.

(56) References Cited

U.S. PATENT DOCUMENTS 4,070,546 A 1/1978 Hirota
2011/0092294 A1* 4/2011 Mercier ..... A63F 13/90 463/46

(Continued)

FOREIGN PATENT DOCUMENTS

JP 52-32302 U 3/1977
JP 58-176487 U 11/1983

(Continued)

OTHER PUBLICATIONS

International Search Report and Written Opinion of PCT Application No. PCT/JP2019/045378, dated Jan. 14, 2020, 09 pages of ISRWO.

*Primary Examiner* — Andrew L Sniezek
(74) *Attorney, Agent, or Firm* — Chip Law Group

(57) ABSTRACT

Provided is an audio reproduction device that includes first and second speaker supports that have a lid shape and are provided on a case in an openable and closable manner, a sensor that detects a first state and a second state, the first and second speaker supports being closed in the first state, the first and second speaker supports being opened and held almost horizontally in the second state, first and second speakers respectively attached on front surfaces of the first and second speaker supports such that a distance in the second state is larger than a distance in the first state, and a reproduction characteristic control unit that switches reproduction characteristics of the first and second speakers in the first state and the second state on the basis of a detection signal from the sensor.

8 Claims, 7 Drawing Sheets

(56) References Cited

U.S. PATENT DOCUMENTS

| | | | | |
|---|---|---|---|---|
| 2015/0176884 | A1* | 6/2015 | Grepper ..... | B65D 51/24<br>220/592.2 |
| 2018/0343509 | A1* | 11/2018 | Lundgard ..... | H04R 1/2803 |

FOREIGN PATENT DOCUMENTS

| | | | |
|---|---|---|---|
| JP | 62-98395 | U | 6/1987 |
| JP | 6-44294 | U | 6/1994 |
| JP | 2001-339785 | A | 12/2001 |
| JP | 2002-078073 | A | 3/2002 |
| JP | 2004-086757 | A | 3/2004 |

* cited by examiner

AUDIO REPRODUCTION DEVICE

CROSS REFERENCE TO RELATED APPLICATIONS

This application is a U.S. National Phase of International Patent Application No. PCT/JP2019/045378 filed on Nov. 20, 2019, which claims priority benefit of Japanese Patent Application No. JP 2018-244036 filed in the Japan Patent Office on Dec. 27, 2018. Each of the above-referenced applications is hereby incorporated herein by reference in its entirety.

TECHNICAL FIELD

The present technology relates to an audio reproduction device in which a plurality of speakers is attached to a case.

BACKGROUND ART

In order to perform audio reproduction, audio reproduction devices, in which a plurality of speakers is integrated for convenience of carriage, are used to enjoy music outdoors. For example, Patent Document 1 discloses configuration in which an operation unit and a display unit are provided on the front surface portion of a box-shaped acoustic device body, a speaker is arranged on the side of the upper surface portion thereof, and an opening/closing lid is provided. The operation unit and the display unit are used to select an operation mode of the acoustic device. The opening/closing lid closes the speaker. Furthermore, a detection element that turns on and off in response to the opening/closing of the above-described opening/closing lid is provided on the acoustic device body. The lid opened state of the above-described opening/closing lid is controlled on the basis of output from a main control unit provided on the above-described acoustic device body. The opening/closing lid has a function as a dustproof acoustic reflection plate.

In the case described in Patent Document 1, a speaker is not attached on a lid. In the lid closed state, a lid completely covers the front surface of the speaker. Thus, good audio reproduction is difficult to be performed.

Furthermore, Patent Document 2 discloses a sound control device including an angle detection unit and a correction unit. The angle detection unit detects an opening angle of a horn unit capable of adjusting a sound directivity angle. The correction unit corrects a sound volume and frequency characteristics in response to changes of the opening angle detected by the angle detection unit.

CITATION LIST

Patent Document

Patent Document 1: Japanese Patent Application Laid-Open No. 2001-339785

Patent Document 2: Japanese Patent Application Laid-Open No. 2004-086757

SUMMARY OF THE INVENTION

Problems to be Solved by the Invention

The sound control device in Patent Document 2 is applied to a horn speaker system including an angle change adapter horn, and does not control the reproduction characteristics in response to changes in position of a speaker.

Consequently, an object of the present technology is to provide an audio reproduction device in which a speaker is attached on a lid-shaped speaker support and good audio reproduction can be performed in both the closed state and the opened state of the speaker support.

Solutions to Problems

The present technology relates to an audio reproduction device including:

first and second speaker supports that have a lid shape and are provided on a case in an openable and closable manner;

a sensor that detects a first state and a second state, the first and second speaker supports being closed in the first state, the first and second speaker supports being opened and held almost horizontally in the second state;

first and second speakers respectively attached on front surfaces of the first and second speaker supports such that a distance in the second state is larger than a distance in the first state; and a reproduction characteristic control unit that switches reproduction characteristics of the first and second speakers in the first state and the second state on the basis of a detection signal from the sensor.

Effects of the Invention

According to at least one embodiment, the present technology can perform audio reproduction in both the closed state and the opened state of a speaker support, and good audio reproduction can be performed by switching reproduction characteristics in accordance with the states. Note that the effects described here are not necessarily limited, and any of the effects described in the present technology or effects different therefrom may be exhibited.

MODE FOR CARRYING OUT THE INVENTION

Hereinafter, an embodiment and the like of the present technology will be described with reference to the drawings. Note that the embodiment and the like described below are preferred specific examples of the present technology, and the contents of the present technology are not limited to the embodiment and the like. Furthermore, in the following description, in order to prevent the illustration from being complicated, a reference sign may be attached to only some of configurations, or some configurations may be illustrated while being simplified.

Figure 1:
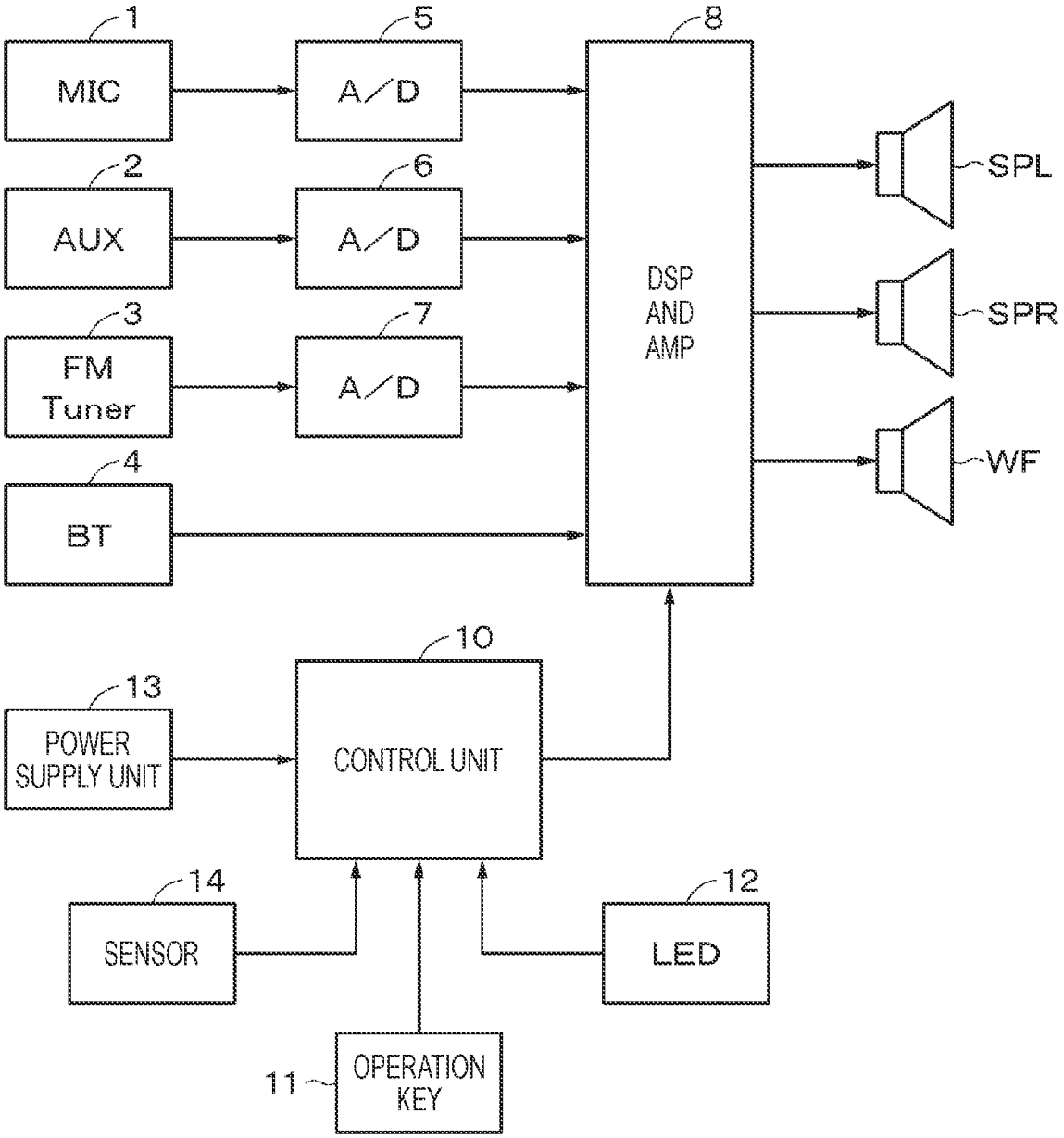
FIG. 1 is a block diagram illustrating the system configuration of one embodiment of the present technology.

The entire system configuration of one embodiment of the present technology will be described with reference to FIG. 1. For example, a microphone input 1, an external analog input 2, output of an FM tuner 3, audio data 4 by wireless transmission such as Bluetooth (registered trademark) are used as an input signal. In addition, input of data stored in a memory such as a flash memory may be possible.

The outputs of the microphone input 1, the external analog input 2, and the FM tuner 3 are converted into digital signals via A/D converters 5, 6 and 7, respectively, and supplied to a digital signal processor (DSP) and an amplifier unit 8. The audio data 4 by wireless transmission is also supplied to the DSP and the amplifier unit 8. The DSP and the amplifier unit 8 have functions of performing signal processing for surround effects and of an amplifier that amplifies an output audio signal and supplies the signal to tweeters SPL and SPR and a woofer WF.

The tweeter SPL on the left side, the tweeter SPR on the right side, and the woofer WF are connected to the DSP and the amplifier unit 8. The tweeters SPL and SPR reproduce a high-range audio signal, and the woofer WF is a speaker for reproducing mid-low pitch sound. The DSP and the amplifier unit 8 perform signal processing for 2.1ch surround. The 2.1ch surround can create spatially expansive surround effects.

A control unit 10 that controls the entire audio reproduction device is provided. The control unit 10 includes, for example, a central processing unit (CPU), a random access memory (RAM), and a read only memory (ROM). A signal from an operation unit 11 such as an operation key is supplied to the control unit 10. The control unit 10 controls the display of a light emitting diode (LED) 12. Moreover, a power supply unit 13 is provided, and power is supplied to each unit. A power supply circuit that generates a DC power supply from a commercial power supply is provided in the power supply unit 13. The power supply unit 13 includes a built-in secondary battery. The control unit 10 controls the charge/discharge of the secondary battery.

Moreover, in one embodiment, as will be described later, a tweeter support serving as a lid-shaped speaker support is provided on an upper part of a case in an openable and closable manner, and a sensor 14 that detects the opening and closing of the speaker support is provided. One example of the sensor 14 is a Hall IC. The Hall IC includes a Hall element. The Hall IC uses a Hall voltage generated by the Hall element at the time when a magnet approaches the Hall element as detection output. For example, in a closed state (referred to as a first state as appropriate) in which a lid is closed, a detection voltage is generated. In an opened state (referred to as a second state as appropriate) in which the lid is opened, the detection voltage is not generated. The detection voltage of the sensor 14 is supplied to the control unit 10. Note that, for example, an optical sensor may be used as the sensor 14 in addition to a magnetic sensor such as the Hall IC.

The control unit 10 forms a control signal for the DSP and the amplifier unit 8 by the detection output of the sensor 14. In one example, the control unit 10 supplies a control signal for performing control of switching the reproduction characteristics as illustrated in Table 1 below to the DSP and the amplifier unit 8.

TABLE 1

| | | First state (closed) | Second state (opened) |
|---|---|---|---|
| Filter cutoff frequency | Woofer WF | 2.8 kHz | 2.5 kHz |
| | Tweeter SPL/SPR | 4.5 kHz | 2.1 kHz |
| Surround processing | | Off | On |

As illustrated in Table 1, in the first state, a filter cutoff frequency applied to a signal for the woofer WF is set at 2.8 kHz, and a filter cutoff frequency applied to a signal for the tweeters SPL and SPR is set at 4.5 kHz. Furthermore, surround processing is not performed.

In the second state, the filter cutoff frequency applied to a signal for the woofer WF is set at 2.5 kHz, and the filter cutoff frequency applied to a signal for the tweeters SPL and SPR is set at 2.1 kHz. Furthermore, surround processing is performed. Note that, in a case where the reproduction characteristics are switched between the first state and the second state, not only frequency characteristics but a signal level may be controlled. The reproduction band, a crossover frequency, a reproduction signal level, a phase of a reproduction signal, on/off of surround processing, and the like are referred to as the reproduction characteristics.

Figure 2:
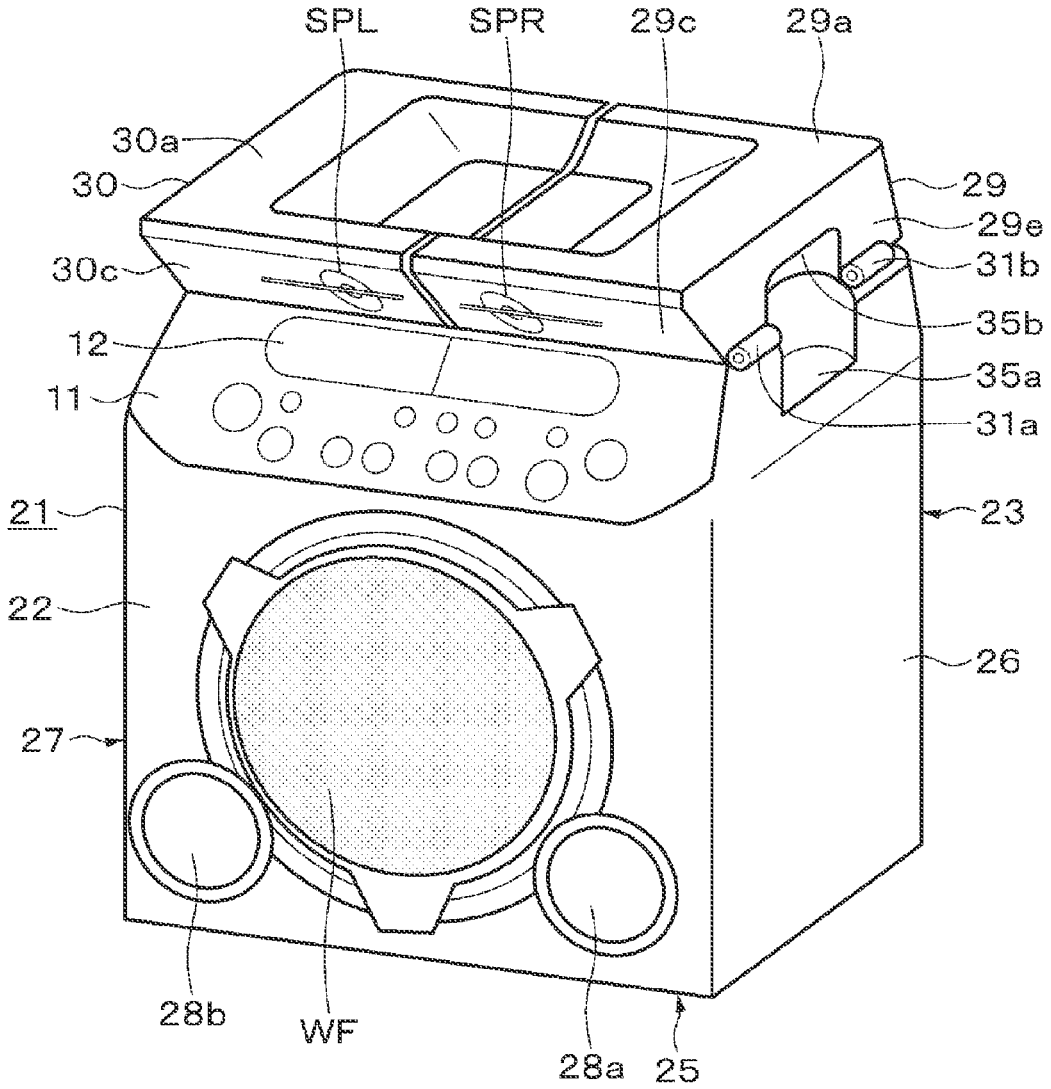
FIG. 2 is a perspective view of the appearance in the state in which a speaker support of one embodiment is closed.
Figure 3:
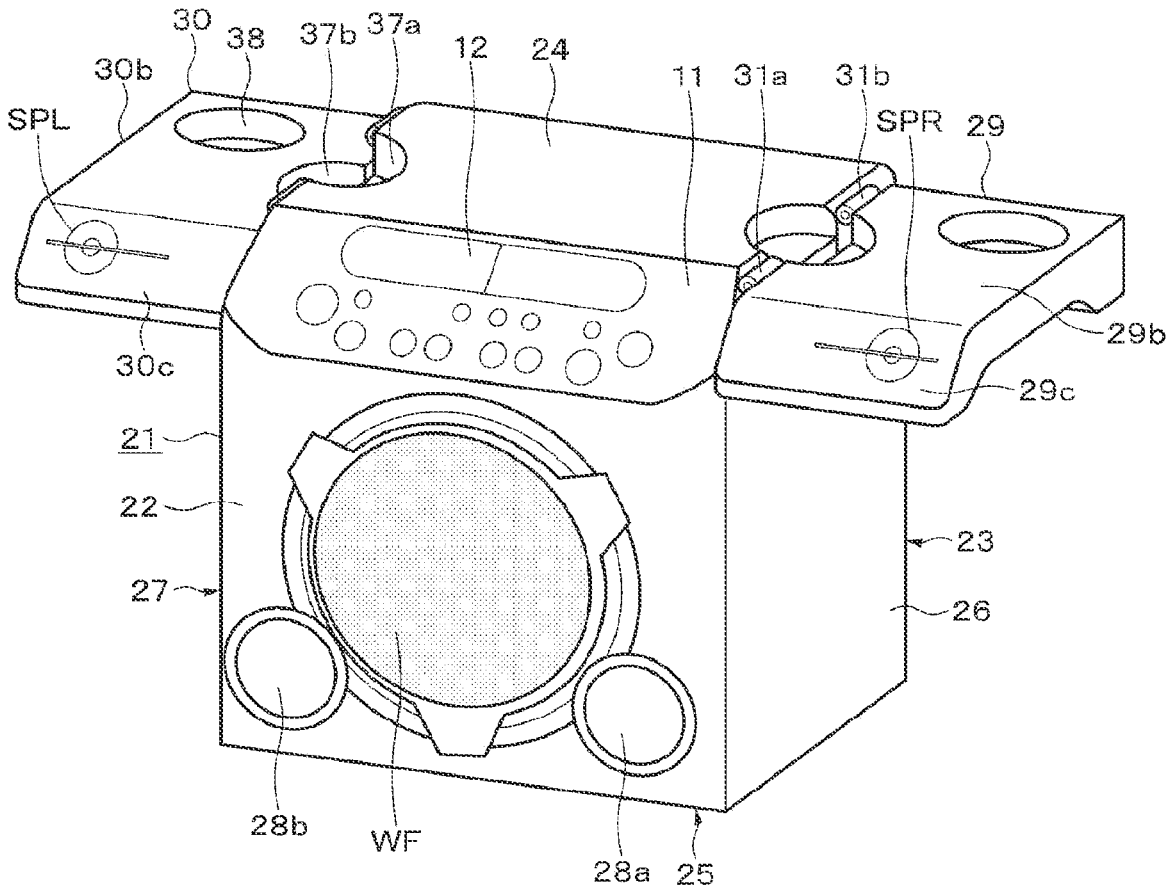
FIG. 3 is a perspective view of the appearance in the state in which the speaker support of one embodiment is opened.
Figure 4:
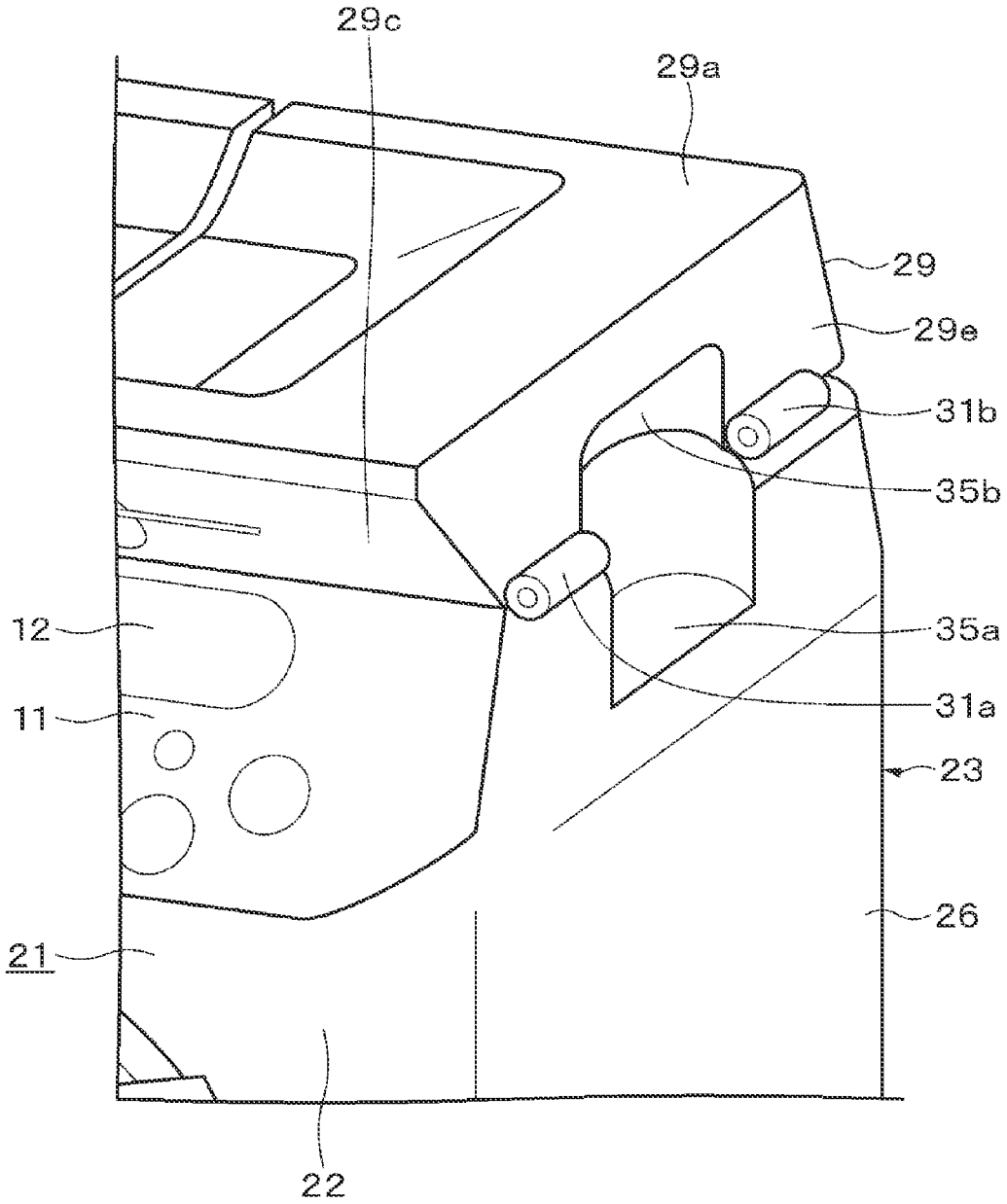
FIG. 4 is a partial perspective view of one embodiment.
Figure 5A:
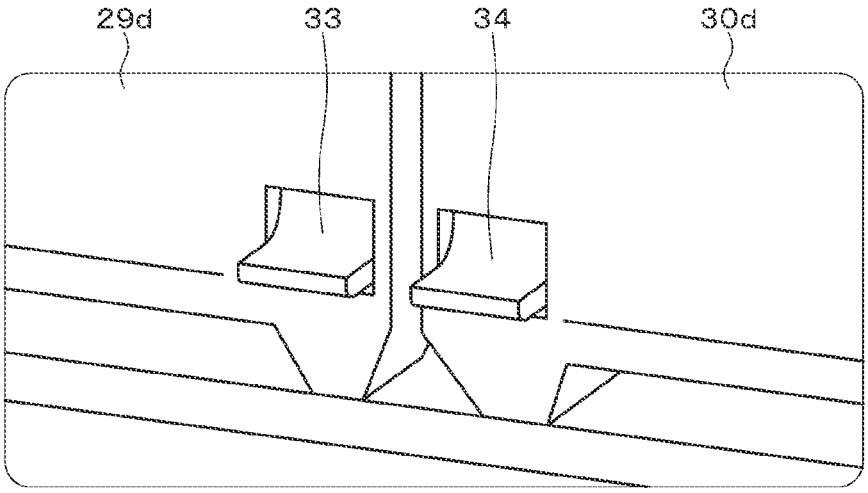
FIGS. 5A and 5B includes a perspective view and a partial perspective view for illustrating a locking mechanism of the speaker support.
Figure 5B:
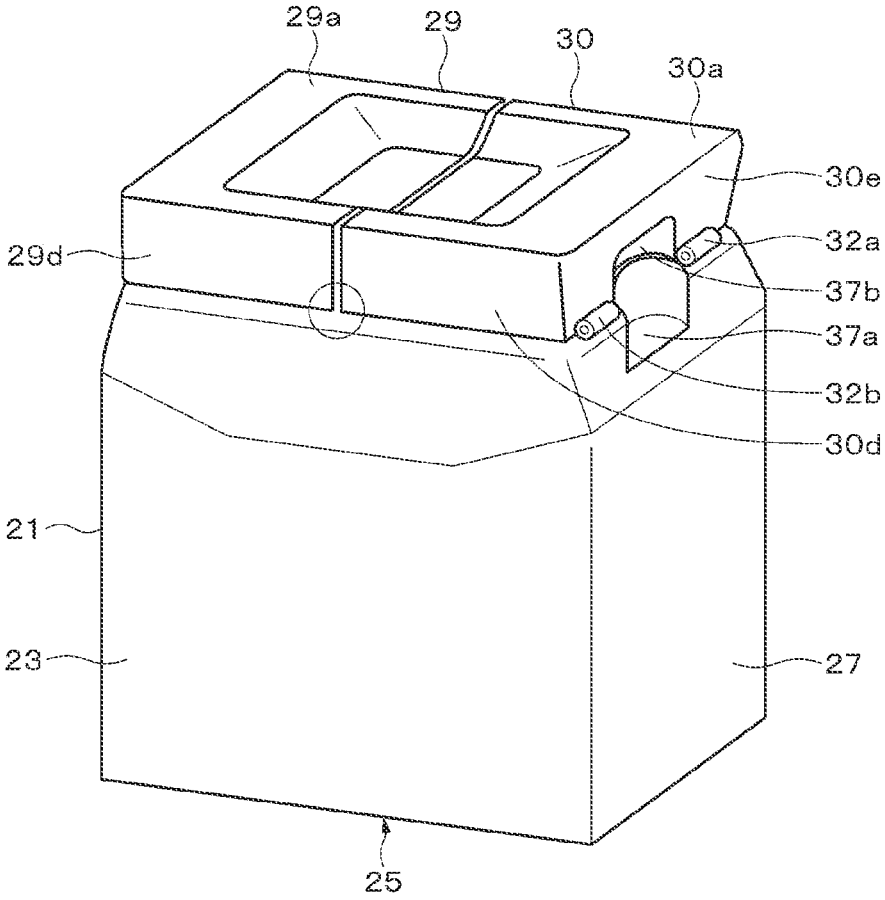
Figure 6:
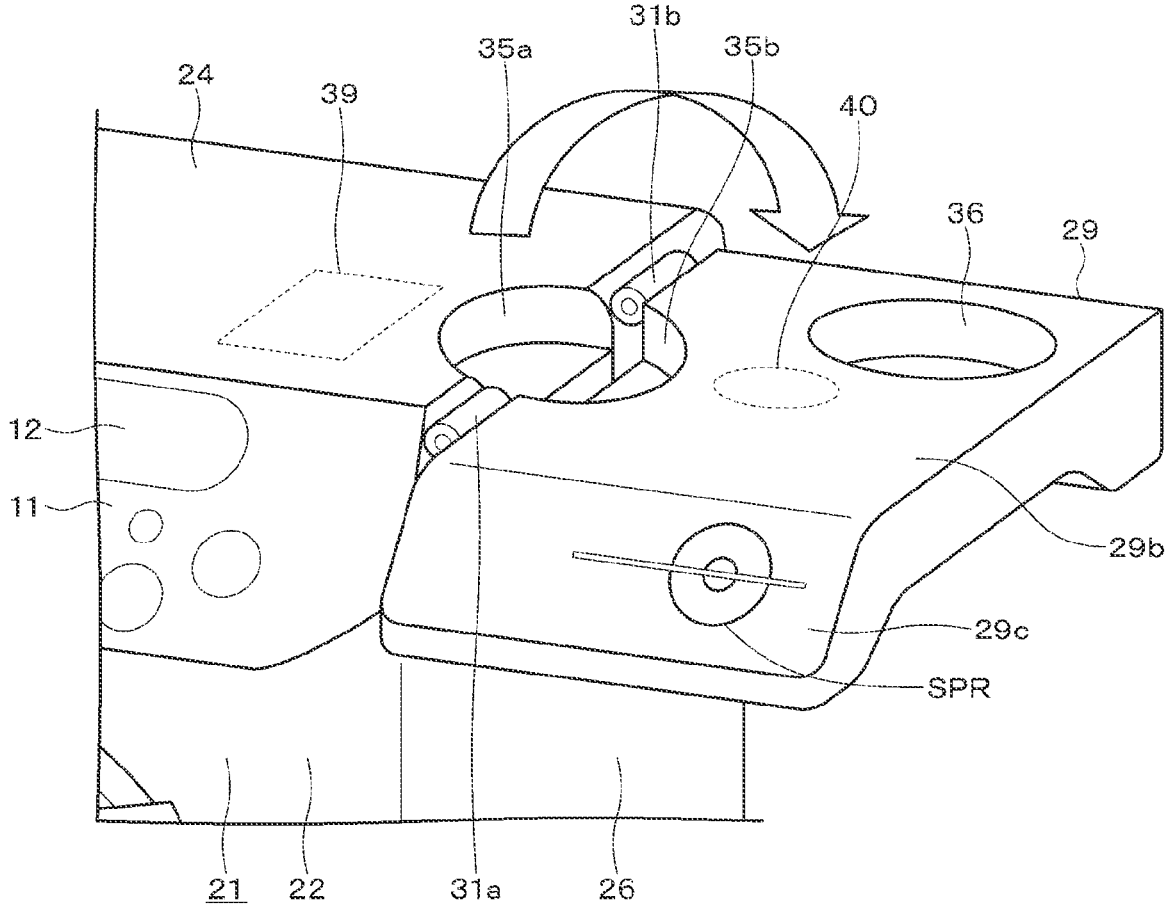
FIG. 6 is a partial perspective view used to illustrate a sensor for detecting the opened/closed state of the speaker support.
Figure 7:
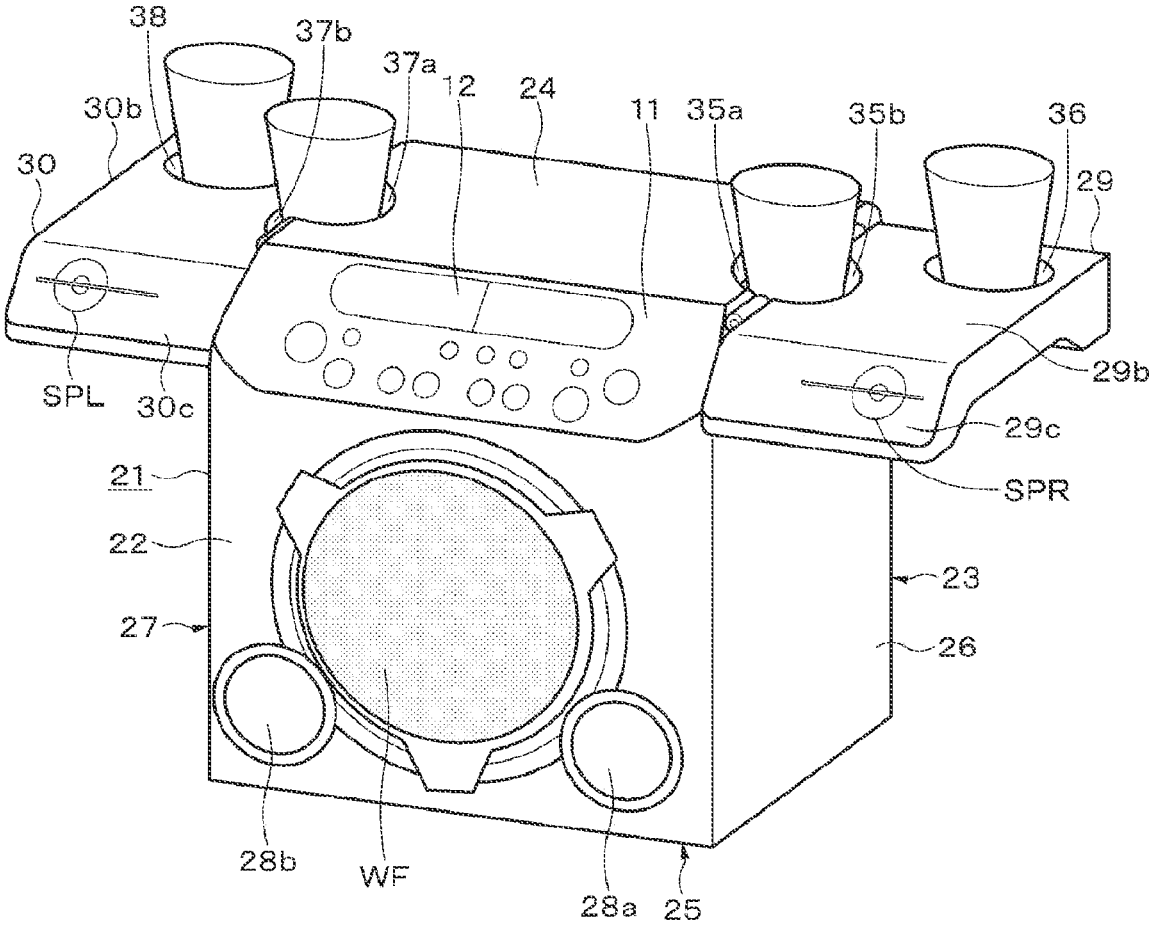
FIG. 7 is a perspective view for illustrating a used state of one embodiment.

FIG. 2 is a perspective view of the appearance in the state (referred to as the first state as appropriate) in which a lid-shaped tweeter support of one embodiment is closed. FIG. 3 is a perspective view of the appearance in the state (referred to as the second state as appropriate) in which the tweeter support of one embodiment is opened. FIG. 4 is a partial perspective view of one embodiment. FIGS. 5A and 5B include a perspective view and a partial perspective view for illustrating a locking mechanism of the tweeter support. FIG. 6 is a partial perspective view used to illustrate a sensor for detecting the opened/closed state of the tweeter support. FIG. 7 is a perspective view for illustrating a used state of one embodiment.

A case 21 has a shape of a box having a front surface 22, a back surface 23, an upper surface 24, a bottom surface 25, a right side surface 26, and a left side surface 27. The case 21 is, for example, a molded product of synthetic resin. The woofer WF is attached on the front surface 22. Bass reflex ducts 28*a* and 28*b* are formed on both sides of the woofer WF. The woofer WF is, for example, a cone type speaker.

An inclined surface is formed between an upper portion of the front surface 22 and the upper surface 24 of the case 21, and the operation unit 11 and the LED 12 are installed on the inclined surface. A wiring board is provided inside the case 21. Electric configurations of a system in FIG. 1 are mounted on the wiring board. The wiring board is installed inside the upper surface 24 of the case 21, for example.

Tweeter supports 29 and 30 serving as lid-shaped speaker supports are rotatably attached on the upper surface 24 of the case 21. The tweeter supports 29 and 30 are provided bisymmetrically. The tweeter support 29 is the size of the right half of the upper surface 24 of the case 21, and has facing main surfaces 29*a* and 29*b*, a front surface 29*c*, a back surface 29*d*, and both side surfaces. The tweeter SPR is attached on the front surface 29*c* of the tweeter support 29. In the first state, the tweeter SPR is attached slightly inside from the center of the front surface 29*c*. In the first state, since the tweeter supports 29 and 30 are housed within the width of the case 21, the audio reproduction device can be easily handled during, for example, transportation and storage.

The tweeter support 30 has a shape similar to that of the tweeter support 29. That is, the tweeter support 30 is the size of the left half of the upper surface 24 of the case 21, and has facing main surfaces 30*a* and 30*b*, a front surface 30*c*, a back surface 30*d*, and both side surfaces. The tweeter SPL is attached on the front surface 30*c* of the tweeter support 30. In the first state, the tweeter SPL is attached slightly inside from the center of the front surface 30*c*. The tweeters SPR and SPL have, for example, a cone type configuration, and include a protective ring on the front surface.

As illustrated in an enlarged manner in FIG. 4, hinges 31*a* and 31*b* couple the case 21 and one side surface 29*e* of the tweeter support 29, which allows the tweeter support 29 to rotate clockwise as seen from the front surface. If the tweeter support 29 is rotated by a hand, the side surface 29*e* of the tweeter support 29 hits the right side surface 26 of the case 21, and the first state transitions to the second state in which the tweeter support 29 is almost horizontally held on the right side of the case 21.

Hinges 32*a* and 32*b* couple the case 21 and one side surface 30*e* of the tweeter support 30, which allows the tweeter support 30 to rotate counterclockwise as seen from the front surface. If the tweeter support 30 is rotated by a hand, the side surface 30*e* of the tweeter support 30 hits the left side surface 27 of the case 21, and the first state transitions to the second state in which the tweeter support 30 is almost horizontally held on the left side of the case 21.

In one embodiment, music can be reproduced both in the first state and the second state. In the first state, the tweeter supports 29 and 30 are placed on the upper surface 24 of the case 21. In the second state, the tweeter supports 29 and 30 are rotated and almost horizontally supported on both sides of the case 21. Since the distance between the tweeters SPL and SPR at the time when music is reproduced in the second state is larger than that at the time when music is reproduced in the first state, music can be expansively reproduced. The respective front surfaces 29*c* and 30*c* of the tweeter supports 29 and 30 are inclined upward so that sound of the tweeters SPL and SPR can be radiated diagonally upward in the second state.

As illustrated in FIG. 5B, locking claws 33 and 34 as illustrated in FIG. 5(*a*) are provided on the back surface 29*d* of the tweeter support 29 and the back surface 30*d* of the tweeter support 30. In a case where the claws 33 and 34 are not lifted, the tweeter supports 29 and 30 are locked so as to be held in the first state. In a case where the claws 33 and 34 are lifted, the lock is released, and the tweeter supports 29 and 30 can be rotated from the first state to the second state.

As illustrated in an enlarged manner in FIG. 4, a cut portion 35*a* is provided near the center (position between the hinges 31*a* and 31*b*) of the joint where an end of the upper surface 24 of the case 21 and an end of the right side surface 26 are in contact with each other. The cut portion 35*a* has a semi-cylindrical shape facing inward from the right side surface 26. A semi-cylindrical cut portion 35*b* of similar size is formed at the position of the tweeter support 29 corresponding to the cut portion 35*a*. The cut portions 35*a* and 35*b* form a recess in the first state, and a finger can be put on the recess at the time when the reproduction device is transported.

These cut portions 35*a* and 35*b* form a cylindrical recess in a case where the tweeter support 29 is opened to the second state. The recess can be used as a cup holder, as illustrated in FIG. 7. A recess 36 having a circular opening is formed on the main surface 29*b* of the tweeter support 29 to be exposed in the second state. The recess 36 can also be used as a cup holder, as illustrated in FIG. 7. Note that these recesses can be used as a holding portion or a placing portion for an article other than a cup as long as the size fits.

A cut portion 37*a* is provided near the center (position between the hinges 32*a* and 32*b*) of the joint where an end of the upper surface 24 of the case 21 and an end of the left side surface 27 are in contact with each other. The cut portion 37*a* has a semi-cylindrical shape facing inward from the left side surface 27. A semi-cylindrical cut portion 37*b* of similar size is formed at the position of the tweeter support 30 corresponding to the cut portion 37*a*. The cut portions 37*a* and 37*b* form a recess in the first state, and a finger can be put on the recess at the time when the reproduction device is transported.

These cut portions 37*a* and 37*b* form a cylindrical recess in a case where the tweeter support 30 is opened to the second state. The recess can be used as a cup holder, as illustrated in FIG. 7. A recess 38 having a circular opening is formed on the main surface 30*b* of the tweeter support 30 to be exposed in the second state. The recess 38 can also be used as a cup holder, as illustrated in FIG. 7.

Note that, in FIG. 6, as illustrated by two-dot chain lines, a Hall element 39 is arranged on the back side of the upper surface 24 of the case 21, and a magnet 40 is provided at a position that approaches the Hall element 39 at the time when the tweeter support 29 is closed on the back side of the main surface 29*b* of the tweeter support 29. In the first state in which the tweeter support 29 is closed, a detection voltage is generated from the Hall element 39, and the control unit can detect the first state. In the second state in which the tweeter support 29 is opened, the detection voltage is not generated, and the control unit can detect the second state. In a manner similar to that of the tweeter support 29, a magnet is provided on the tweeter support 30, and the control unit can detect the opening/closing of the tweeter support 30. In a case where the control unit detects a state in which both the tweeter supports 29 and 30 are closed, the control unit defines the state as the first state. In a case where the control unit detects a state in which both the tweeter supports 29 and 30 are opened, the control unit defines the state as the second state.

Although the embodiment of the present technology has been specifically described above, the above-described embodiment is not a limitation. Various variations based on the technical idea of the present technology are possible. For example, configurations of not 2.1ch but 3.1ch and the like may be adopted. For example, the upper three speakers may be arranged side by side. The left and right speakers may be attached on a lid-shaped support. The central speaker may be fixed. Moreover, a speaker of types other than the cone type can be used.

The configurations, methods, processes, shapes, materials, numerical values, and the like mentioned in the above-described embodiment are merely examples, and different configurations, methods, processes, shapes, materials, numerical values, and the like may be used as necessary. The above-described embodiment and variations can be combined as appropriate.

The present technology can also adopt the following configurations.

(1)

An audio reproduction device including:

first and second speaker supports that have a lid shape and are provided on a case in an openable and closable manner;

a sensor that detects a first state and a second state, the first and second speaker supports being closed in the first state, the first and second speaker supports being opened and held almost horizontally in the second state;

first and second speakers respectively attached on front surfaces of the first and second speaker supports such that a distance in the second state is larger than a distance in the first state; and a reproduction characteristic control unit that switches reproduction characteristics of the first and second speakers in the first state and the second state on the basis of a detection signal from the sensor.

(2)

The audio reproduction device according to (1), in which the first and second speakers are tweeters, and a woofer is provided on the case on a lower side of the speaker support.

(3)

The audio reproduction device according to (1) or (2), in which the reproduction characteristic control unit switches reproduction characteristics such that surround processing is turned off in the first state and the surround processing is turned on in the second state.

(4)

The audio reproduction device according to any one of (1) to (3), in which the speaker support is provided on an upper surface of the audio reproduction device, the first and second speakers are attached on front surfaces of the first and second speaker supports, and the front surfaces are inclined so that radiation directions of the first and second speakers are set obliquely upward in the second state.

(5)

The audio reproduction device according to any one of (1) to (4), including a locking mechanism that holds the first state of the first and second speaker supports.

(6)

The audio reproduction device according to any one of (1) to (5), in which first and second cut portions are respectively formed at a joint between a side surface and an upper surface of the case and a corresponding position on a side surface of the first and second speaker supports, the first and second cut portions form a recess in the first state, and the first and second cut portions form a recess usable as a holding portion or a placing portion for an article in the second state.

(7)

The audio reproduction device according to any one of (1) to (6), in which another recess usable as a holding portion or a placing portion for an article is formed on main surfaces of the first and second speaker supports, which are exposed in the second state.

REFERENCE SIGNS LIST

SPL, SPR Tweeter
WF Woofer
8 DSP and Amplifier unit
10 Control unit
21 Case
29, 30 Speaker support
31*a*, 31*b*, 32*a*, 32*b* Hinge

The invention claimed is:

1. An audio reproduction device, comprising:

a first speaker support and a second speaker support that have a lid shape, wherein the first speaker support and the second speaker support are on a case in an openable and closable manner;

a sensor configured to detect one of a first state or a second state of the first speaker support and the second speaker support to generate a detection signal, wherein the first speaker support and the second speaker support are closed in the first state, the first speaker support and the second speaker support are open in the second state, and the first speaker support is horizontal with respect to the second speaker support in the second state;

a first speaker on a front surface of the first speaker support;

a second speaker on a front surface of the second speaker support, wherein a distance between the first speaker and the second speaker in the second state is larger than a distance between the first speaker and the second speaker in the first state; and a reproduction characteristic control unit is configured to switch reproduction characteristics of each of the first speaker and the second speaker based on the detection signal, wherein the reproduction characteristics are switched in the first state and the second state of each of the first speaker and the second speaker, and the reproduction characteristics are switched such that surround processing for each of the first speaker and the second speaker is turned off in the first state and the surround processing for each of the first speaker and the second speaker is turned on in the second state.

2. The audio reproduction device according to claim 1, wherein the first speaker and the second speaker are tweeters, and the case includes a woofer on a lower side of the first speaker support and the second speaker support.

3. The audio reproduction device according to claim 1, wherein each of the first speaker support and the second speaker support is on an upper surface of the audio reproduction device, and the front surface of the first speaker support and the front surface of the second speaker support are inclined such that radiation directions of the first speaker and the second speaker are obliquely upward in the second state.

4. The audio reproduction device according to claim 1, further comprising a locking mechanism configured to hold the first state of each of the first speaker support and the second speaker support.

5. The audio reproduction device according to claim 1, wherein a joint between a side surface and an upper surface of the case includes a first cut portion, side surface of the first speaker support and the second speaker support includes a second cut portion at a position corresponding to the first cut portion, the first cut portion and the second cut portion form a first recess in the first state, and the first cut portion and the second cut portion form a second recess usable as one of a holding portion or a placing portion in the second state.

6. The audio reproduction device according to claim 1, wherein each of the first speaker support and the second speaker support includes a main surface, the main surface of each of the first speaker support and the second speaker support includes a recess usable as a holding portion or a placing portion, and the recess is exposed in the second state.

7. An audio reproduction device, comprising:

an upper surface;

a first speaker support and a second speaker support that have a lid shape, wherein the first speaker support and the second speaker support are openable and closable on the upper surface;

a sensor configured to detect one of a first state or a second state of the first speaker support and the second speaker support to generate a detection signal, wherein the first speaker support and the second speaker support are closed in the first state, the first speaker support and the second speaker support are open in the second state, and the first speaker support is horizontal with respect to the second speaker support in the second state;

a first speaker on a front surface of the first speaker support;

a second speaker on a front surface of the second speaker support, wherein a distance between the first speaker and the second speaker in the second state is larger than a distance between the first speaker and the second speaker in the first state, and the front surface of the first speaker support and the front surface of the second speaker support are inclined such that radiation directions of the first speaker and the second speaker are obliquely upward in the second state; and a reproduction characteristic control unit configured to switch reproduction characteristics of each of the first speaker and the second speaker based on the detection signal, wherein the reproduction characteristics are switched in the first state and the second state of each of the first speaker and the second speaker.

8. An audio reproduction device, comprising:

a first speaker support and a second speaker support that have a lid shape, wherein the first speaker support and the second speaker support are openable and closable on a case;

a sensor configured to detect one of a first state or a second state of the first speaker support and the second speaker support to generate a detection signal, wherein the first speaker support and the second speaker support are closed in the first state, the first speaker support and the second speaker support are open in the second state, and the first speaker support is horizontal with respect to the second speaker support in the second state;

a first speaker on a front surface of the first speaker support;

a second speaker on a front surface of the second speaker support, wherein a distance between the first speaker and the second speaker in the second state is larger than a distance between the first speaker and the second speaker in the first state; and a reproduction characteristic control unit is configured to switch reproduction characteristics of each of the first speaker and the second based on the detection signal, wherein the reproduction characteristics are switched in the first state and the second state of each of the first speaker and the second speaker;

the case includes a side surface and an upper surface, a joint of the side surface and the upper surface includes a first cut portion, each of the first speaker support and the second speaker support includes a side surface, the side surface of each of the first speaker support and the second speaker support includes a second cut portion at a position corresponding to the first cut portion, the first cut portion and the second cut portion form a first recess in the first state, and the first cut portion and the second cut portion form a second recess usable as one of a holding portion or a placing portion in the second state.

* * * * *